United States Patent [19]

Sugimoto

[11] Patent Number: 4,755,456

[45] Date of Patent: Jul. 5, 1988

[54] METHOD FOR PREPARING SILVER IODOBROMIDE EMULSIONS HAVING HIGH ASPECT RATIO

[75] Inventor: Tadao Sugimoto, Kanagawa, Japan

[73] Assignee: Fuji Photo Film Co., Ltd., Kanagawa, Japan

[21] Appl. No.: 947,129

[22] Filed: Dec. 29, 1986

[30] Foreign Application Priority Data

Dec. 26, 1985 [JP] Japan ..... 60-294553

[51] Int. Cl.[4] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 4,184,878 | 1/1980 | Maternaghan | 430/567 |
| 4,414,310 | 11/1983 | Daubendiek et al. | 430/567 |
| 4,434,226 | 2/1984 | Wilgus et al. | 430/567 |
| 4,585,729 | 4/1986 | Sugimoto et al. | 430/567 X |
| 4,665,012 | 5/1987 | Sugimoto et al. | 430/567 X |

*Primary Examiner*—Mukund J. Shah

*Attorney, Agent, or Firm*—Sughrue, Mion, Zinn, Macpeak & Seas

[57] ABSTRACT

A method for preparing a light-sensitive silver iodobromide emulsion having a high aspect ratio, the emulsion containing a dispersion medium and silver iodobromide grains, with grains having a grain size of not less than 0.5 μm, a thickness of not more than 0.3 μm, and an average aspect ratio of not less than 5 constituting at least 50% of the total project area of emulsion grains, comprising (a) introducing a silver salt, and a bromide salt or a bromide salt and iodide salt into a reactor in which at least part of the dispersion medium has been introduced, (b) controlling the iodide ion concentration indicated by pI in the reactor prior to the introduction of at least the silver salt and the bromide salt within the range represented by the equation (I) as shown below:

$$\frac{1.50}{pBr} + 1.20 \leqq pI \leqq \frac{2.60}{pBr} + 1.33 \qquad \text{(I)}$$

wherein pI and pBr indicate the logarithmic values of reciprocals of concentrations of dissolved iodide ions and bromide ion, respectively, and (c) maintaining the pBr at not less than 0.8 after the introduction of the silver salt, and bromide salt or the bromide salt and iodide salt.

7 Claims, 6 Drawing Sheets

METHOD FOR PREPARING SILVER IODOBROMIDE EMULSIONS HAVING HIGH ASPECT RATIO

FIELD OF THE INVENTION

The present invention relates to a method for preparing light-sensitive silver halide emulsions containing silver iodobromide grains having a high aspect ratio. The term "aspect ratio" as used herein means the ratio of project area diameter of a grain to the thickness of the grain. This project area diameter (hereinafter referred to merely as a "grain size") means a diameter of a circle having an area equal to the project area of the grain, and the thickness of grains means the distance between two parallel faces constituting a tabular grain.

BACKGROUND OF THE INVENTION

Silver halide emulsions which can be used in a high sensitive silver halide light-sensitive material having sensitivity which can be used for the usual camera usually comprise silver iodobromide grains having a face-centered cubic crystal in which a solid solution is formed by silver iodide. A limiting amount of silver iodide having a face-centered cubic crystal in which a solid solution is formed is not more than 45 mol %. Usually, however, industrially important silver iodobromide is often used in such a manner that the silver iodide content is in the range of from 0.1 to 20 mol %.

As industrially important silver iodobromide emulsion grains, those in forms such as cubic, octahedral, dodecahedral, spherical and tabular are known. It is also known that tabular grains have a high covering force and further have high graininess, sharpness and color sensitization efficiency due to sensitization dyes. This is described in detail in *Research Disclosure,* Vol. 225, Item 22534, pp. 20–58 (January, 1983).

Tabular silver iodobromide emulsions have been prepared mainly by a method in which soluble silver salts such as silver nitrate are added to a solution containing bromide salts and iodide salts, i.e., the so-called single jet method as described in A. P. H. Trivelli & W. F. Smith, *Photographic Journal,* Vol. 80, p. 285 (1940) and Duffin, *Photographic Emulsion Chemistry,* The Focal Press, New York, pp. 66–72 (1966). However, the tabular silver iodobromide grains prepared by the above method have a broad grain size distribution and light-sensitive materials prepared using such tabular silver iodobromide grains are low in contrast. Thus, such light-sensitive materials are limited in their use, therefore, they are usually used as only negative light-sensitive materials for cameras. Furthermore, in accordance with the above method, the intragrain and intergrain silver iodide content distributions are broad and it is very difficult to control these silver iodide content distributions. As described in Japanese Patent Application (OPI) No. 99433/84 (the term "OPI" as used herein refers to a "published unexamined Japanese patent application"), the distribution of silver iodide in the inside of the grain not only has significant influences on anti-pressure characteristics, but also has definite influences on photographic sensitivity, gradation, rate of development and so forth. Thus, it is industrially very important to completely control the above silver iodide distribution. Accordingly, it is a disadvantage inherent to the single jet method that the grain size distribution and the silver iodide distribution in silver iodide grains and between silver iodide grains are substantially difficult to control.

To overcome the disadvantage of the single jet method that the grain size distribution is broad, U.S. Pat. No. 4,067,739 discloses a method in which a solution of bromide salt and silver iodide salt and a solution of silver nitrate are mixed in the presence of gelatin, the resulting mixture is subjected to physical ripening in the presence of a silver halide solvent to form seed crystals which are in the form of twinned crystals, and then silver nitrate and bromide salts are added under accelerated speed by the double jet method while maintaining the pBr at not less than 0.15 to thereby prepare tabular silver iodobromide grains having a narrow grain size distribution. In addition, U.S. Pat. Nos. 4,150,994, 4,184,877, 4,184,878, British Patent No. 1,570,581, West German Patent Application (OLS) Nos. 2,905,655 and 2,921,077 disclose a method in which silver halide containing at least 90 mol % of silver iodide is used as a seed crystal and, thereafter, silver iodobromide grains having a tabular twinned crystal form and having a narrow size distribution are formed by the double jet method. In accordance with this method, however, it is still difficult to control the silver iodide content distribution in the inside of and between the grains. Furthermore, since the tabular grains thus obtained are generally relatively thick grains, the resulting silver iodobromide emulsion is not an emulsion having a high aspect ratio which sufficiently exhibits the features of tabular grains as described above.

E. B. Gutoff, *Photographic Science and Engineering,* Vol. 14, page 248 (1970) discloses that a silver iodobromide emulsion having a high aspect ratio as defined in the present invention and Japanese Patent Application (OPI) No. 113928/83 can be obtained by introducing the solutions of bromide salt, iodide salt, silver salt and gelatin at the same time and then further continuously adding these solutions while maintaining the pBr at a constant value in the range of from 0.49 to 1.43. This method, however, has a fundamental problem that since it employs a continuous steady state method in which the emulsion formed is continuously withdrawn corresponding to the speed of addition of the solute and since nuclei are constantly being formed due to the method and are intermingled with finely divided tabular grains, there is an increase in the grain size distribution. Furthermore, since the distribution of silver iodide in the tabular silver iodobromide obtained in the inside of and between the grains is naturally uniform, it is impossible to control at will the silver iodide content at a specified position in the inside of the grains. Thus, the emulsion thus obtained is usually high in pressure fog, as described in Japanese Patent Application (OPI) No. 99433/84.

As a method of preparing silver iodobromide having a high aspect ratio, Japanese Patent Application (OPI) No. 113928/83 discloses a method in which the pBr of a dispersion medium in a reactor prior to the introduction of iodide salt is controlled to 0.6 to 1.6, the reactor prior to the introduction of silver salt and bromide salt is maintained in such a state as not to contain soluble iodide, and the pBr in the reactor is maintained at least at 0.6 during the process of introducing iodide. A similar method is disclosed in European Patent No. 84,637$A_2$. U.S. Pat. No. 4,414,310 discloses a method for preparing a silver iodobromide emulsion having a high aspect ratio by using as seed crystals high iodine content silver halide grains (silver iodide content of not less than 90 mol %) which belong to the hexagonal crystal system and which have a diameter of not more than 0.1 μm, and adding the silver salt and bromide salt solutions by the double jet method. In these methods, it is an important condition that substantially no soluble iodide salt is incorporated in the reactor prior to the introduction of the silver salt and bromide salt. In connection with the reason for that, Japanese Patent Application (OPI) No. 113928/83 describes that if iodide ions are previously dissolved in the solution phase, the silver iodobromide tabular grains formed are relatively thick and furthermore the number of non-tabular grains is increased to obtain a low aspect ratio. In connection with this, a detailed discussion appears in Trivelli & Smith, *Photographic Journal,* Vol. 80, pp. 285–288 (1940) which is referred to in Japanese Patent Application (OPI) No. 113928/83 and U.S. Pat. No. 4,414,310.

Therefore, it is generally considered that it is an essential condition to minimize the dissolution of iodide ions in the dispersion medium prior to the introduction of silver salt and bromide salt in order to obtain silver iodobromide grains having a high aspect ratio.

It can be generally said that a method for preparing a silver iodobromide emulsion having a high aspect ratio by the double jet method as described in Japanese Patent Application (OPI) No. 113928/83 and European Patent No. 84,637$A_2$ has advantages in that the distribution of silver iodide in the inside of the grains can be relatively easily controlled, and further as compared with the single jet method and so forth, the grain size distribution can be made narrow to a certain extent. However, in the case where a high iodine content silver halide having a hexagonal crystal is used as a seed crystal, as described in U.S. Pat. No. 4,414,310, since, in a similar manner as in U.S. Pat. No. 4,150,994, the iodine distribution in the inside of the grain and between the grains basically depends on the balance between the dissolution of the high iodine content seed crystals and the speed of addition of silver salt and bromide salt, it is generally difficult to control the iodine distribution. It is therefore desirable that silver iodide is introduced directly in a solid solution form in the silver iodobromide grain from the beginning by using a known amount of soluble iodide salt to thereby control the silver iodide distribution in the inside of the grain.

In preparing a tabular silver iodobromide emulsion having a high aspect ratio by the double jet method, a practical problem is encountered that when the same emulsion is repeatedly produced, the reproducibility is generally very poor, as compared with the conventional emulsions, at the time of transferring from a small scape production to a large scale and when trying to reproduce at the same scale. This problem is assumed to be the result of fact that since the possibility of forming a twinned crystals along with a normal crystals during the formation of nuclei is greatly influenced by a slight change in pBr, then a slight change in the balance between the stirring condition and the speeds of addition of silver nitrate and silver bromide has substantial influences on the iodide ion concentration and the concentration distribution in the reactor. It is therefore desired to develop a method to decrease a large change in the probability of forming a twinned crystals due to a change in pBr during the introduction of the silver salt and bromide salt.

A high contrast is needed in an X-ray light-sensitive material, a positive light-sensitive material and a reversal light-sensitive material. In general, however, tabular grains having a high aspect ratio as produced even by the double jet method have a broad size distribution and thus a light-sensitive material having a high contrast is difficult to produce. Furthermore, if the size distribution is broad, the graininess is seriously reduced by large sized grains. Therefore, in preparing light-sensitive materials as described above, it is desirable for seed grains of a tabular double twinned crystals prior to the start of growth to be divided as finely as possible and to have a narrow size distribution. The reason for this, as described in Sugimoto, *Photographic Science and Engineering,* Vol. 28, pp. 137–145 (1984), is that changes in the size distribution of tabular grains having a high aspect ratio after the growth can be controlled to be smaller level when the change in the average size and distribution of seed grains is smaller. Furthermore, if the grain size of the seed grain is small, the grain size after the growth can be freely chosen. Of course, as described in J. S. Wey & R. W. Strong, *Photographic Science and Engineering,* Vol. 21, page 248 (1977), if the degree of supersaturation is decreased by lowering the speed of addition of a solute at the time of growth, the grain size distribution of the grown grain is broadened. If a light-sensitive material having a low contrast, in particular, is desired, the grain size distribution of the grown grain can be free to control. Thus, such tabular seed grains have a high degree of freedom in the manner in which they are used to produce grown grains.

As a result of extensive investigations, the present inventors have succeeded in developing a method for preparing a tabular silver iodobromide emulsion having a high aspect ratio which satisfies the above-described requirements.

SUMMARY OF THE INVENTION

An object of the present invention is to provide a method for preparing a light-sensitive silver halide emulsion comprising silver iodobromide grains having a high aspect ratio which has a relatively narrow grain size distribution and is improved in the reproducibility of grain size and grain size distribution in repeated production.

The present invention relates to a method for preparing a high sensitive silver iodobromide emulsion having a high aspect ratio. More specifically, the present invention is concerned with a method for preparing a light-sensitive silver iodobromide emulsion having a high aspect ratio, the emulsion containing a dispersion medium and silver iodobromide grains, with grains having a grain size of not less than 0.5 μm, a thickness of not more than 0.3 μm, and an average aspect ratio of not less than 5 constituting at least 50% of the total project area of the emulsion grains, comprising (a) introducing a silver salt and a bromide salt or a bromide salt and iodide salt into a reactor in which at least part of the dispersion medium has been introduced, (b) controlling the iodide ion concentration indicated by pI, in the reactor prior to the introduction, of at least the silver salt and the bromide salt or the bromide salt and iodide salt within the range represented by the equation (I) as shown below, $$\frac{1.50}{pBr} + 1.20 \leqq pI \leqq \frac{2.60}{pBr} + 1.33 \qquad \text{(I)}$$

wherein pI and pBr indicate the logarithmic values of reciprocals of concentrations of dissolved iodide ions and bromide ion, respectively, and (c) maintaining the pBr at not less than 0.8 after the introduction of the silver salt and bromide salt or the bromide salt and iodide salt.

BRIEF DESCRIPTION OF THE DRAWINGS

FIG. 1 is an electron microphotograph of Sample A of Reference Example 1;

FIG. 2 is an electron microphotograph of Sample B of Reference Example 1;

FIGS. 3 and 4 are electron microphotographs of emulsions prepared as comparative examples in Reference Example 1;

FIG. 5 is an electron microphotograph of Emulsion I-1 of Example 1;

The curves are for the following pBrs.

Curve 1: pBr 1.10
Curve 2: pBr 1.25
Curve 3: pBr 1.70
Curve 4: pBr 1.85
Curve 5: pBr 3.00

"No" indicates the number of all grains formed at the beginning, and "Nt" indicates the number of grains having tabular double twinned crystals formed.

Figure 7:
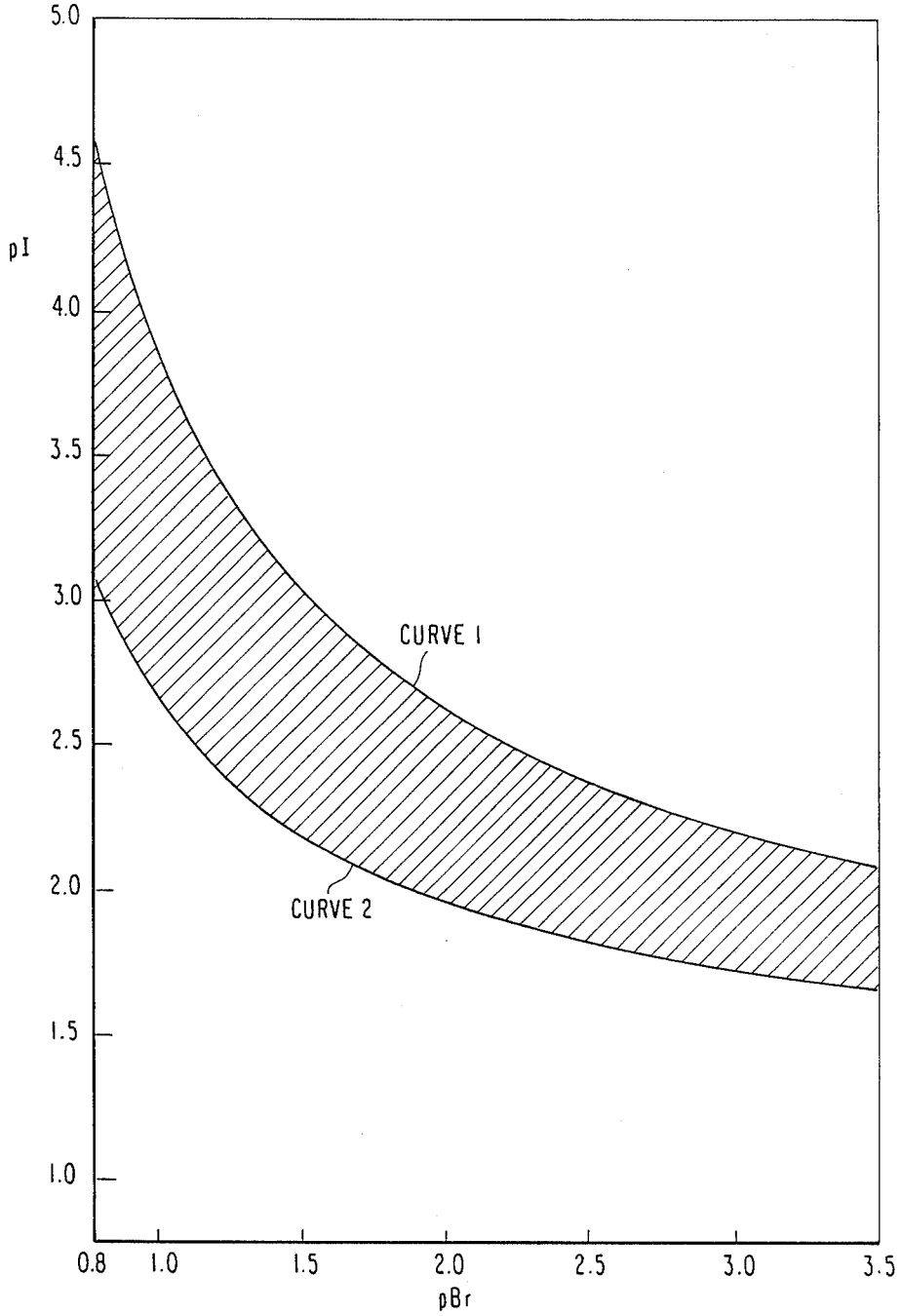

FIG. 7 shows a region of the high probability of forming tabular grains having twinned crystals, which is represented by the hatched area.

In FIG. 7, Curve 1 corresponds to the formula:

$$pI = \frac{2.60}{pBr} + 1.33$$

and Curve 2 corresponds to the formula:

$$pI = \frac{1.50}{pBr} + 1.20$$

In FIG. 7, the ordinate axis indicates pI, and the transverse axis indicates pBr.

Figure 8:
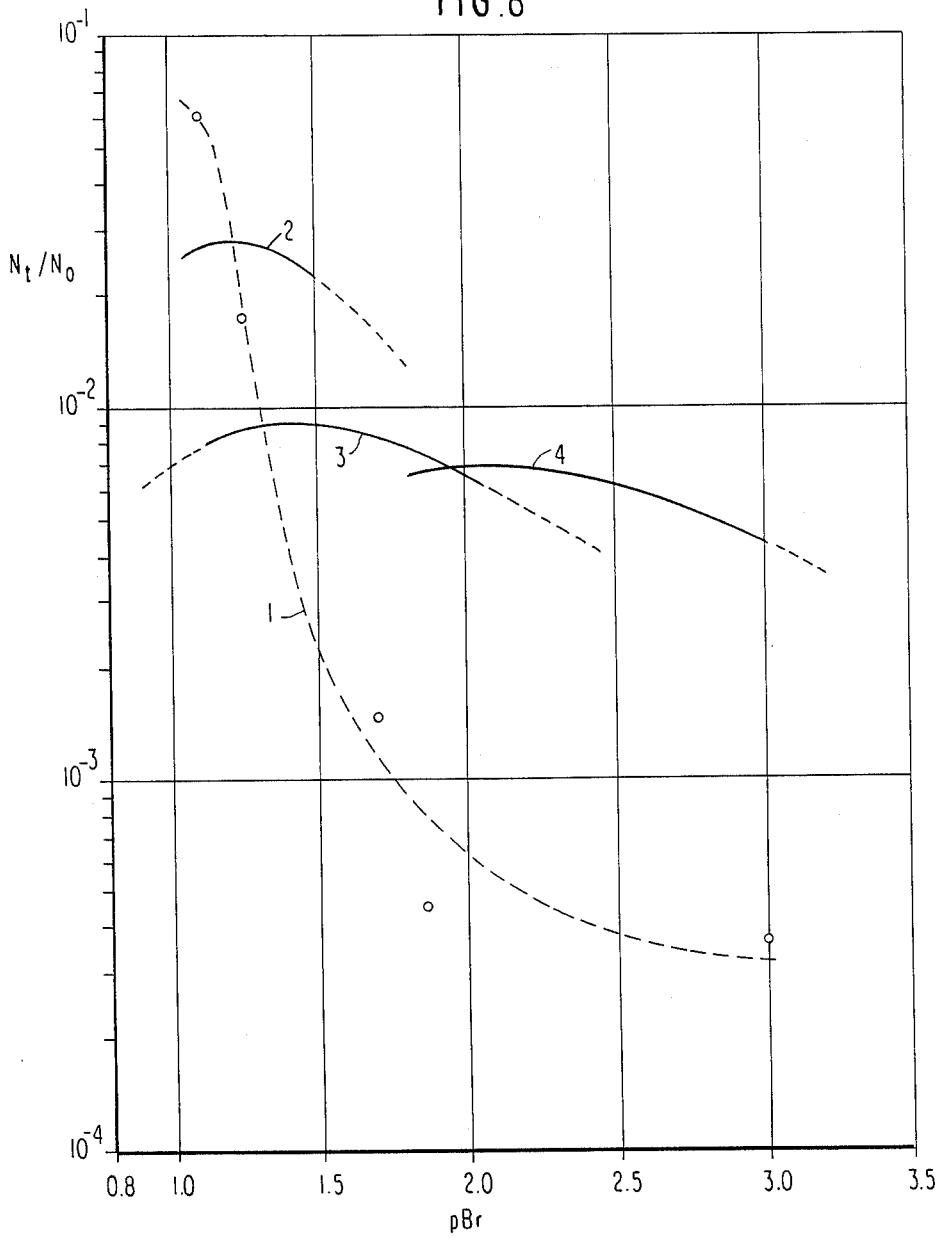

FIG. 8 indicates the relation between pBr and Nt/No at each KI concentration.

The curves are at the following KI concentrations.

Curve 1: KI=0 (control)
Curve 2: KI=$2\times10^{-3}$ M
Curve 3: KI=$4.0\times10^{-3}$ M
Curve 4: KI=$8.0\times10^{-3}$ M The ordinate axis indicates Nt/No, and the transverse axis indicates pBr.

DETAILED DESCRIPTION OF THE INVENTION

In the method of the present invention, it is important, as described above, that the value of pI at the start of addition of a soluble silver salt solution (e.g., silver nitrate, silver perchlorate, etc.) and/or a halide solution (e.g., potassium bromide, ammonium bromide, sodium bromide, potassium iodide, ammonium iodide, sodium iodide, etc.) satisfies the equation (I).

That is, it is important that the value of pI at the earliest stage at which silver halide grain nuclei are substantially formed satisfies equation (I).

In the preparation method of the present invention, the value of pBr in a reactor prior to addition of a soluble silver salt solution is preferably 0.8 to 3.5, more preferably 1.2 to 3.0, and most preferably 1.2 to 2.0. If the pBr value is less than 0.8, the thickness of tabular grains is increased, thereby resulting in non-parallel twinned crystals (i.e., crystal faces of the twinned crystals are non-parallel with each other), and the probability of forming tabular grains is markedly decreased, with the result that grains having a high aspect ratio are formed only with high difficulties. On the other hand, if the pBr value is in excess of 3.5, the probability of forming a parallel twinned crystal (tabular shape) or a non-parallel twinned crystal, i.e., so-called twinned crystal type grain is decreased, therefore, the grains having a high aspect ratio become difficult to obtain.

The pBr value just after the start of addition of a soluble silver solution is preferably not less than 0.8 and more preferably not less than 1.2. If the pBr value is not less than 0.8, a non-parallel twinned crystal is formed only with difficulties, therefore, the grown tabular grains having a high aspect ratio (parallel twinned crystals) are formed with ease.

The pI value prior to the preparation of the silver iodobromide grains is needed in the present invention to satisfy the relation indicated by equation (I) and preferably the equation (II).

$$\frac{1.50}{pBr} + 1.30 \leqq pI \leqq \frac{2.60}{pBr} + 1.23 \qquad \text{(II)}$$

In the method of the present invention, at the time of introducing a silver salt and a bromide salt, or a bromide salt and an iodide salt to a reactor containing bromide ions and iodide ions indicated by the equation (I) in a dispersion medium, the silver salt may be added continuously or intermittently at suitable intervals. During this period, the pBr value can be changed within the range of not less than 0.8 or the temperature in the reactor can be changed.

Particularly preferably a method is used in which finely divided silver iodobromide grains (grain size: usually not more than 0.1 μm) are first prepared using a part of a silver salt to be used and are subjected to physical ripening by adding a silver halide solvent to remove tabular grains as much as possible, and then these grains, freed of such tabular grains, are used as seed crystals and are allowed to grow by adding a silver salt and a halide salt. In this case, the finely divided silver iodobromide grains prepared at the beginning before the physical ripening have an average silver iodide content of not more than 40 mol % and are the face-centered cubic crystals. The average grain size of the seed crystals is usually from about 0.2 to 3 μm, preferably from 0.3 to 1.5 μm, and particularly preferably from 0.5 to 1.0 μm. In accordance with this method, the grain size of the seed crystals can be greatly decreased and furthermore the variation coefficient of grain size distribution of the seed crystals can be maintained at a low level. It goes without saying that the size distribution of tabular grains grown to the desired size can be made narrow by using as seed crystals the finely divided grains having a narrow size distribution.

Particularly in the case where a light-sensitive material having a high contrast is needed, the speed of addition of a solute is increased according to the growth of grains, as described in Japanese Patent Application (OPI) Nos. 8660/73, 39027/76, U.S. Pat. No. 4,242,445 and West German Patent Application (OLS) No. 2,921,164, to thereby grow always at the neighborhood of the speed of critical growth so that the size distribution can be sufficiently narrow. On the contrary, when a light-sensitive material of low contrast is needed, an emulsion having a broad size distribution can be prepared by decreasing the degree of supersaturation for the growth of grains by decreasing the solute addition speed. The principle of the method for controlling the grain size distribution is described in detail in J. S. Wey & R. W. Strong, *Photographic Science and Engineering*, Vol. 21, page 248 (1977) and Sugimoto, *Hyomen* (*Surface*), Vol. 22, page 177 (1984). Accordingly, in accordance with the present invention, the degree of freedom for controlling the size distribution of tabular silver iodobromide grains obtained is greatly increased.

The above method of the present invention does not include the continuous steady state method. This continuous steady state method indicates a method in which the steady state is maintained by extracting a formed emulsion in balance with the speed of addition of a solute as described in U.S. Pat. Nos. 3,415,650, 4,046,576, J. S. Wey, Z. H. Leubner and J. P. Terwilliger, *Photographic Science and Engineering*, Vol. 27, page 35 (1983), E. B. Gutoff, *Photographic Science and Engineering*, Vol. 14, page 248 (1970), and so forth. That is, in this continuous steady state method, the average size, size distribution, halogen composition and so forth of the formed silver halide do not depend at all on the initial conditions, therefore, the relation of pI and pBr at the initial stage, which is a factor of the present invention, does not have any meaning.

The continuous steady state method has a problem that the grain size distribution is substantially increased because the density of grain number in the system is kept constant in constantly forming nuclei during the process of preparing the grains. In view of this point, the continuous steady state method works against one of the important objects of the present invention to obtain seed crystals having as narrow a size distribution as possible.

In the present invention, silver iodobromide is prepared always in such a manner that the average silver iodide content is not more than 40 mol %. Accordingly, the silver salt is added without interruption until the amount of silver salt reaches about at least 2.5 times the amount of soluble iodide previously added, to the reactor prior to the introduction thereof. The amount of silver salt added at the initial stage is preferably at least 5 times, more preferably at least 20 times, the amount of soluble iodide contained in the dispersion medium in the reactor.

The emulsion prepared by the method of the present invention is composed mainly of silver iodobromide grains. The average silver iodide content of silver iodobromide grains is not more than 40 mol %, preferably from 0.01 to 30 mol % and more preferably from 0.1 to 20 mol %.

The distribution of silver iodide in the inside of the grain may be uniform, the silver iodide concentration may be high in the inner portion, or the silver iodide concentration may be high in the outer layer.

The present invention is directed to a method for preparing silver iodobromide having a high aspect ratio, comprising mixed crystals of silver bromide and silver iodide. However, the presence of a solid solution of silver chloride is not always excluded. For example, silver chloride may be contained in a proportion of from about 1 to 40 mol % of the total quantity. The silver chloride content is preferably not more than 20 mol %.

Tabular grains prepared by the present invention may be grains of the multilayer structure, comprising at least two layers having different halogen compositions.

The tabular grains prepared by the present invention may be epitaxial grains in which crystals are grown on specific portions of the surface of the tabular grains. These grains can be prepared by the methods described in Japanese Patent Application (OPI) Nos. 33540/84 and 162540/84.

The grain size distribution of the tabular silver halide grains can be made narrow by using the method of the present invention.

The preparation method of the present invention is used to prepare a silver halide emulsion mainly comprising silver iodobromide grains having a high aspect ratio, having an average aspect ratio of not less than 5, preferably, it is used to prepare grains having an average aspect ratio of 5 to 25, and particularly preferably to prepare grains having an average aspect ratio of 5 to 15.

In determining the aspect ratio, tabular grains having a grain size of not less than 0.5 μm and a thickness of not more than 0.3 μm are prepared, and the average value of grain sizes is divided by the average value of grain thicknesses to obtain the aspect ratio.

The method of the present invention is used to prepare an emulsion in which silver halide grains mainly composed of silver iodobromide having a high aspect ratio are present in a proportion of 50 to 100%, preferably at least 70%, particularly preferably at least 85%, based on the total project area.

The thickness of the tabular grain is not more than 0.3 μm, preferably 0.005 to 0.3 μm and particularly preferably 0.01 to 0.2 μm.

The diameter of the tabular grains is preferably 0.5 to 10 μm, more preferably 0.5 to 5.0 μm and most preferably 0.6 to 3.0 μm.

In the present invention, the reaction temperature at the time of formation of the silver halide grains is not critical; it is usually 20° to 100° C. and preferably 35° to 85° C.

The size of the tabular silver halide grains can be controlled by controlling the temperature, the type and amount of a solvent, the type of silver salt used at the time of grain growth, the addition speed of halide, and so forth.

The grain size, grain form (e.g., diameter/thickness ratio), the grain size distribution and the growth speed of the grains can be controlled by using, if desired, a silver halide solvent at the time of preparing the tabular silver halide grains. The amount of the solvent used is preferably $1\times10^{-3}$ to 1.0 wt %, particularly preferably $1\times10^{-2}$ to $1\times10^{-1}$ wt % of the reaction solution.

For example, as the amount of the solvent used is increased, the grain size distribution is made monodisperse and the growth speed is increased. On the other hand, as the amount of the solvent used is increased, the thickness of the grains tends to be increased.

Examples of silver halide solvents which are often used are thiocyanic acid salts, ammonia, thioether and thioureas.

For example, thiocyanic acid salts (e.g., described in U.S. Pat. Nos. 2,222,264, 2,448,534 and 3,320,069), ammonia, thioether compounds (e.g., described in U.S. Pat. Nos. 3,271,157, 3,574,628, 3,704,130, 4,297,439 and 4,276,347), thione compounds (e.g., described in Japanese Patent Application (OPI) Nos. 144319/78, 82408/78 and 77737/80), amine compounds (e.g., described in Japanese Patent Application (OPI) No. 100717/79) and so forth can be used.

Cadmium salts, zinc salts, lead salts, thallium salts, iridium salts or complex salts thereof, rhodium salts or complex salts thereof, iron salts or complex salts thereof and so forth may be coexisted during the process of forming or physical ripening, of the silver halide grains.

In the method of the present invention, a soluble silver salt solution and a soluble halide solution may be added in any desired manner.

That is, each solution may be added at a constant speed, or in order to accelerate the grain growth, there may be employed a method in which the addition speed of the soluble silver salt solution and/or the soluble halide solution, the amount of addition and the concentration of addition are increased.

In the practice of the above method, the descriptions appearing in British Patent No. 1,335,925, U.S. Pat. Nos. 3,672,900, 3,650,757, 4,242,445, Japanese Patent Application (OPI) Nos. 142329/80 and 158124/80, which are hereby incorporated by reference, can be referred to.

Each solution may be added continuously or intermittently.

Any of the single jet method, the double jet method, a combination thereof, and so forth can be employed.

There can be employed a method in which grains are formed in the presence of an excess of silver ions (so-called reverse mixing method). As one embodiment of the double jet method, there can be employed a method in which the pAg in the liquid phase where a silver halide is formed is maintained at a constant level, i.e., socalled controlled double jet method. In accordance with this method, there can be obtained a silver halide emulsion in which the crystal form is regular and the grain size is nearly uniform.

Two or more silver halide emulsions as prepared independently may be used in combination with each other.

In addition, any of the acid method, the neutral method and the aμmonia method can be used to form the grains.

The tabular silver halide grains formed by the present invention can be subjected to chemical sensitization, if desired.

For this chemical sensitization, the methods described in, for example, H. Frieser, *Die Grundlagen der Photographischen Prozesse mit Silberhalogeniden,* Akademische Verlagsgesellschaft (1968), pp. 675–734 can be used.

That is, a sulfur sensitization method using sulfur-containing compounds capable of reacting with active gelatin or silver (e.g., thiosulfuric acid salts, thioureas, mercapto compounds and rhodanines), a reduction sensitization method using reducing substances (e.g., stannous salts, amines, hydrazine derivatives, formamidinesulfinic acid and silane compounds), and a noble metal sensitization method using noble metal compounds (e.g., gold complex salts and the complex salts of Group VIII metal such as Pt, Ir and Pd) can be used singly or in combination with each other.

More specifically, the sulfur sensitization method is described in U.S. Pat. Nos. 1,574,944, 2,410,689, 2,278,947, 2,728,668 and 3,656,955, the reduction sensitization method is described in U.S. Pat. Nos. 2,983,609, 2,419,974 and 4,054,458, and the noble metal sensitization method is described in U.S. Pat. Nos. 2,399,083, 2,448,060 and British Patent 618,061.

In particular, in the case of the tabular silver halide grains of the present invention, gold sensitization or sulfur sensitization, or a combination thereof is preferably used.

As a dispersion medium (a binder or protective colloid) for the photographic emulsion of the present invention, it is advantageous to use gelatin. In addition, other hydrophilic colloids may be used.

For example, proteins such as gelatin derivatives, graft polymers of gelatin and other polymers, albumin and casein; sugar derivatives such as cellulose derivatives, e.g., hydroxyethyl cellulose, carboxymethyl cellulose and cellulose sulfate, sodium alginate and starch derivatives; and various hydrophilic synthetic polymers of homopolymers or copolymers, such as polyvinyl alcohol, polyvinyl acetal partial acetal, poly-N-vinyl pyrrolidone, polyacrylic acid, polymethacrylic acid, polyacrylamide, polyvinyl imidazole and polyvinyl pyrazole can be used.

As gelatin, as well as lime-processed gelatin, acid-processed gelatin and enzyme-processed gelatin described in *Bull. Soc. Sci. Phot. Japan,* No. 16, page 30 (1966) may be used. In addition, hydrolyzate and enzyme decomposition products of gelatin can be used. As gelatin derivatives, compounds resulting from the reaction of gelatin and various compounds such as acid halide, acid anhydride, isocyanates, bromoacetic acid, alkanesultones, vinylsulfonamides, maleinimide compounds, polyalkylene oxides and epoxy compounds can be used.

Representative examples of dispersion media which can be used in the present invention are described in *Research Disclosure,* Vol. 176, No. 17643 (December, 1978), Clause IX.

In the photographic emulsion which is formed in the present invention, various compounds can be incorporated for the purpose of preventing fog or of stabilizing its photographic characteristics during the process of preparation, storage or photographic processing of the light-sensitive material. That is, many compounds known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; thioketo compounds such as oxazolinethione; azaindenes such as triazaindenes, tetraazaindenes (particularly 4-hydroxy-substituted (1,3,3a,7)tetraazaindenes) and pentaazaindenes; benzenethiosulfonic acid; benzenesulfinic acid; and benzenesulfonic acid amide can be added. Such compounds are described in, e.g., U.S. Pat. Nos. 3,954,474 and 3,982,947 and Japanese Patent Publication No. 28660/77 in more detail.

Representative methods of using them are described in, for example, U.S. Pat. Nos. 3,954,474, 3,982,947 and Japanese Patent Publication No. 28660/77.

The photographic emulsion layer or other hydrophilic colloid layer of the light-sensitive material of the present invention may contain various surface active agents as coating aids, or for various purposes of, e.g., preventing electrification, improving sliding properties, accelerating emulsification and dispersion, preventing adhesion, and improving photographic characteristics (e.g., acceleration of development, an increase in contrast and sensitization).

For example, nonionic surface active agents such as saponin (steroid type), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, and silicon/polyethylene oxide adducts), glycidol derivatives (e.g., alkenylsuccinic acid polyglyceride and alkylphenol polyglyceride), fatty acid esters of polyhydric alcohols, and alkyl esters of sugar; anionic surface active agents containing an acidic group, such as a carboxyl group, a sulfo group, a phospho group, a sulfate group and a phosphate group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphorics acid esters; amphoteric surface active agents such as amino acids, aminoalkylsulfonic acids, aminoalkylsulfuric acid or phosphoric acid esters, alkylbetaines and amine oxides; and cationic surface active agents such as alkylamine salts, aliphatic or aromatic quaternary ammonium salts, heterocyclic quaternary ammonium salts such as pyridinium and imidazolium, and aliphatic or heterocyclic ring-containing phosphonium or sulfonium salts can be used.

In the present invention, fluorine-containing compounds can be used for purposes of, e.g., preventing electrification, preventing adhesion, improving sliding properties, or as coating aids. Representative examples of such compounds include low molecular weight compounds as described in Japanese Patent Application (OPI) Nos. 10722/74, 16525/75, 84712/78, 48520/79, 14224/79, 43636/81, 26719/82, 146248/82, 114945/81, 196544/83, 200235/83, Japanese Patent Application No. 236390/84, British Patent Nos. 1,259,398 and 1,417,915, polymeric compounds as described in U.S. Pat. Nos. 4,175,969, 4,087,394, 4,016,125, 3,676,123, 3,679,411, 4,304,852, Japanese Patent Application (OPI) Nos. 129520/77, 158222/79, 57842/80, 11342/82, 19735/82, 179837/82, Japanese Patent Application No. 202438/85, *Kagaku Sosetsu No.* 27, *Atarashii Fusso Kagaku (A New Fluorine Chemistry),* edited by Nippon Kagakukai (1980), and Satokawa, *Kinousei Ganfusso Kobunshi (Functional Fluorine-Containing Polymers),* Nikkan Kogyo Shinbun Sha (1982), or inorganic compound as described in Japanese Patent Application (OPI) No. 165650/85.

The photographic emulsion layer which is prepared by the present invention may contain compounds such as a polyalkylene oxide, derivatives such as ether, ester, or amine, of a polyalkylene oxide, thioether compounds, thiomorpholines, quaternary ammonium salt compounds, urethane derivatives, urea derivatives, imidazole derivatives and 3-pyrazolidones for the purpose of increasing sensitivity or contrast, or accelerating development.

The photographic light-sensitive material which is prepared by the present invention may contain a dispersion of water-insoluble or sparingly water-soluble synthetic polymer in its photographic emulsion layer and other hydrophilic colloid layers for purpose of, e.g., improving dimensional stability. For example, homo- or copolymers of alkyl acrylate or alkyl methacrylate, alkoxyalkyl acrylate or alkoxyalkyl methacrylate, glycidyl acrylate or glycidyl methacrylate, acrylamide or methacrylamide, vinyl esters (e.g., vinyl acetate), acrylonitrile, olefin and styrene, and copolymers of the above monomers and monomers such as acrylic acid, methacrylic acid, $\alpha,\beta$-unsaturated dicarboxylic acid, hydroxyalkyl acrylate or hydroxyalkyl methacrylate, sulfoalkyl acrylate or sulfoalkyl methacrylate, and styrenesulfonic acid can be used.

The photographic emulsion which is prepared in the present invention may be subjected to spectral sensitization for blue light having a relatively long wavelength, green light, red light or infrared light by the use of sensitizing dyes. As such sensitizing dyes, a cyanine dye, a merocyanine dye, a complex cyanine dye, a complex merocyanine dye, a holopolar cyanine dye, a styryl dye, a hemicyanine dye, an oxonol dye, a hemioxonol dye and the like can be used.

It is advantageous for these sensitizing dyes to be used in such a dye concentration that the inherent sensitivity of the silver halide emulsion is not substantially decreased. The sensitizing dye is used preferably in an amount of from about $1.0\times10^{-5}$ to $5\times10^{-3}$ mol per mol of silver halide, and more preferably in an amount of about $4\times10^{-5}$ to $2\times10^{-3}$ mol, per mol of silver halide.

As sensitizing dyes which are used in the present invention, compounds as described in *Research Disclosure,* Vol. 176, Item 17643, Clause IV, page 23 (December, 1978) can be used.

These sensitizing dyes can be used by adding them at any stage during the process of preparing the photographic emulsion, or by adding them at any stage just before coating after its preparation. Examples of the former case include a step of forming silver halide grains, the step of physical ripening and the step of chemical ripening.

The emulsion of the present invention may contain color image-forming couplers as described below, i.e., compounds capable of forming color through oxidative coupling reaction with an aromatic primary amine developing agent (e.g., phenylenediamine derivatives and aminophenol derivatives) at the color developing step. The coupler desirably is a nondiffusible one having a hydrophobic group called a ballast group in the molecule thereof, or desirably is a polymerized one. The coupler may be 4-equivalent or 2-equivalent relative to silver ion. Colored couplers having the effect of color correction or couplers releasing a development inhibitor (so-called DIR couplers) may be employed. In addition, non-color-forming DIR coupling compounds producing a colorless coupling reaction product and releasing a development inhibitor may be employed.

Examples of magenta couplers include a 5-pyrazolone coupler, a pyrazolobenzimidazole coupler, a cyanoacetylcumarone coupler, and an open chain acylacetonitrile coupler. Examples of yellow couplers include an acylacetamide coupler (e.g., benzoylacetanilides and pivaloylacetanilides). Examples of cyan couplers include a naphthol coupler and a phenol coupler.

The photographic light-sensitive material of the present invention may contain an inorganic or organic hardener in its photographic emulsion layer or other hydrophilic colloid layers. For example, chromium salts (e.g., chromium alum and chromium acetate), aldehydes (formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl2-propanol), active halogen compounds (e.g., 2,4-dichloro-6-hydroxy-s-triazine), and mucohalogenic acids (e.g., mucochloric acid and mucophenoxychloric acid) can be used alone or in combination with each other.

In the emulsion of the present invention, the aforementioned various additives can be employed. Details are described in *Research Disclosure,* Vol. 176, Item 17643, pp. 23–28 (December, 1978), and ibid., Vol. 187, Item 18716, pp. 648–650 (November, 1979).

Other additives described in these references can also be used.

The silver halide emulsion of the present invention can be provided on a support in a structure of one layer or two or more layers (e.g., two layers and three layers) in combination with other emulsions, if desired. In addition, the emulsion of the present invention can be provided not only on one side of the support, but also on both sides. In addition, emulsions having different color sensitivities can be provided in a multilayer structure.

The silver halide emulsion of the present invention can be used in a black-and-white silver halide photographic material (e.g., an X-ray light-sensitive material, a lith type light-sensitive material and a negative film for black-and-white photographing) and a color photographic light-sensitive material (e.g., a color negative film, a color reversal film and a color paper). In addition, it can be used in a light-sensitive material for diffusion transfer (e.g., a color diffusion transfer element and a silver salt diffusion element), a heat development light-sensitive material and so forth.

The present invention is described below in greater detail with the reference examples and the examples.

REFERENCE EXAMPLE 1

50 ml of 4 N $AgNO_3$ was added over 75 seconds at a constant speed to 1 liter of an aqueous solution containing 15 g of inactive gelatin, 2.4 g of potassium bromide and 0.50 g (3.0 mmol) of potassium iodide (pBr: 1.70, pI: 2.52) while maintaining the aqueous solution at 70° C. and stirring it well. During this process, 4 N KBr was added at the same time so as to maintain the pBr at 1.70, and just before the completion of addition of $AgNO_3$, the addition of KBr was stopped so that the pBr at the completion of the addition of the $AgNO_3$ was 1.85. After 30 seconds, 10 ml of 2 N KSCN was added and physical ripening was conducted for 30 minutes. Just after the completion of addition of the $AgNO_3$, 15 ml of the emulsion was taken out and 10 ml of a 0.1 wt % methanol solution of 1-phenyl-5-mercaptotetrazole was added thereto to instantly stop the growth of grains. This is referred to as Sample A. On the other hand, 2 N KSCN was added and then physical ripening was conducted for 30 minutes. Simultaneously with the completion of this physical ripening, 15 ml of the emulsion was taken out and 10 ml of a 0.1 wt % methanol solution of 1-phenyl-5-mercaptotetrazole was added thereto to stop the growth of grains. This is referred to as Sample B.

Figure 1:
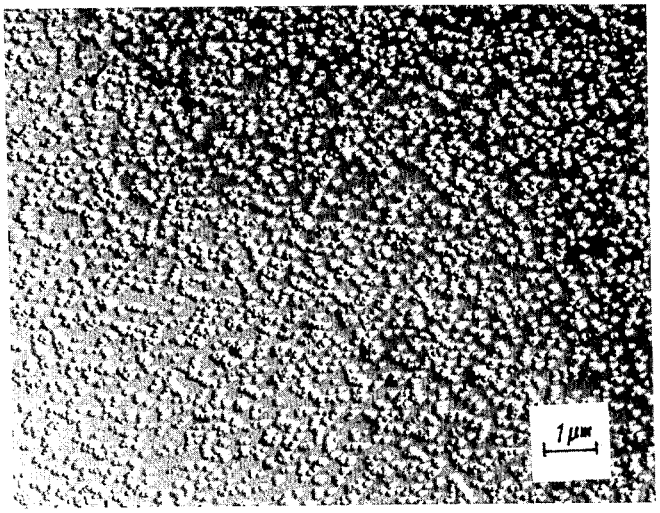
FIGS. 1 to 5 are each an electron microphotograph showing the shape of silver halide grain, in which the magnification is shown in the unit of 1 μm.

Sample A is composed of fine grains which have an average grain diameter of 0.085 μm and which are apparently nearly spherical (FIG. 1). Just after addition of $AgNO_3$ and KBr, apparently spherical finely divided grains contain a double twinned crystal nucleus with a certain probability. Thus, when potassium thiocyanate as a silver halide solvent is added, regular crystals and single twinned crystals which are not double twinned crystal nuclei are dissolved, resulting in precipitation of the solute in double twinned crystal nuclei, and thus double twinned crystal nuclei grow, leaving tabular grains having a high aspect ratio. This is, as described in Sugimoto, *Photographic Science and Engineering,* Vol. 28, page 137 (1984), based on a very rapid isometric growth characteristic of a double parallel twinned crystal.

Figure 2:
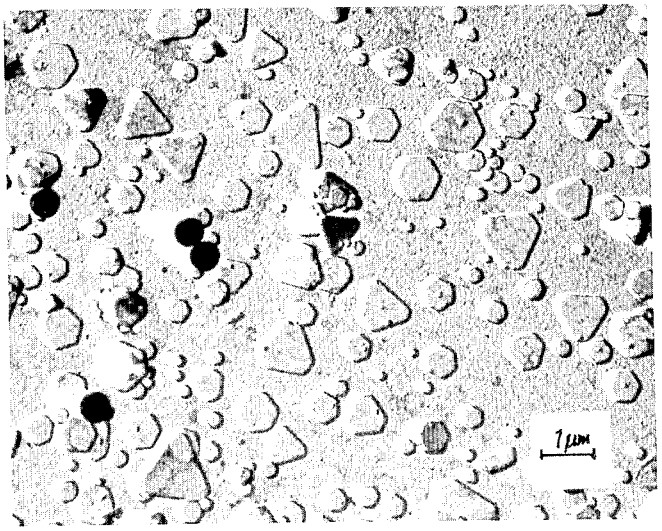
Figure 6:
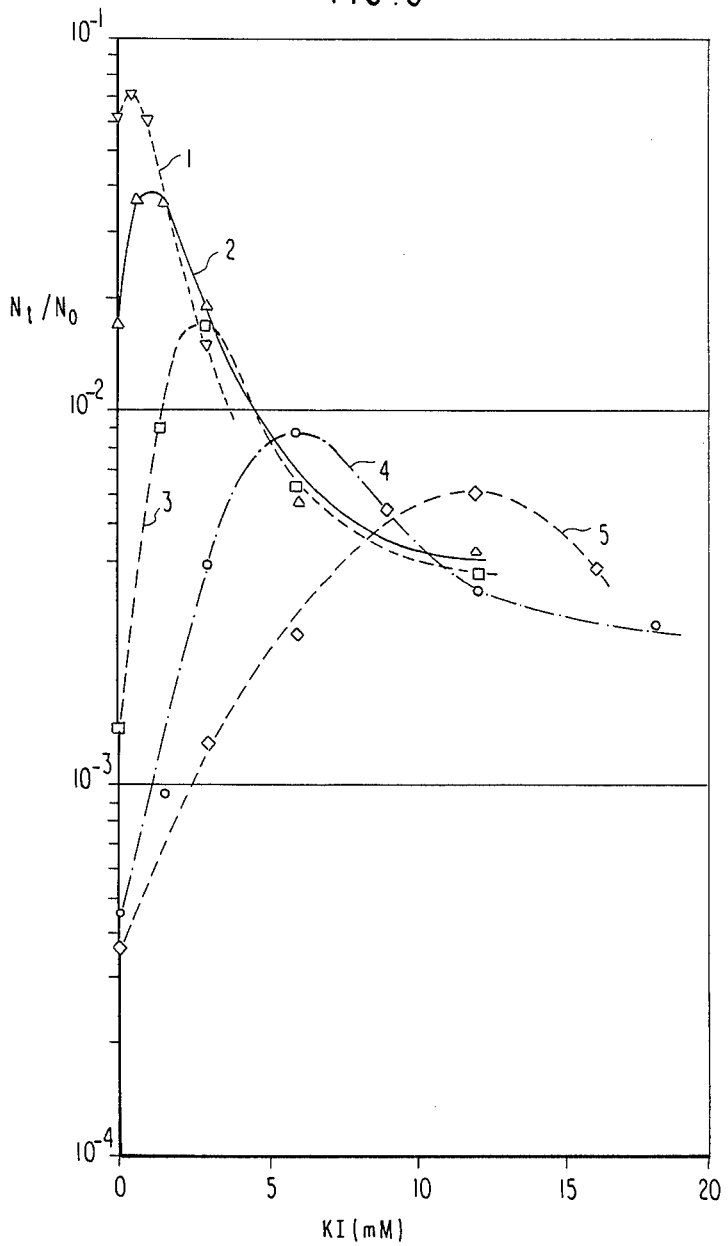
FIG. 6 shows the relation between the Nt/No value (ordinate axis) and the KI concentration (transverse axis) at each pBr.

Grains observed in Sample B are tabular double twinned crystal grains and finely divided grains of undissolved regular crystals and single twinned crystals (FIG. 2). Assuming that the total number of grains first formed from the average size as determined from an electron microphotograph of Sample A is No, and when Nt/No is calculated by the number of grains (Nt) of tabular double twinned crystals as determined from each average volume of the tabular double twinned crystals, the normal crystals and the single twinned crystals to number ratio based on an electron microphotograph of carbon replica subjected to shadowing of Sample B, Nt/No is $1.70\times10^{-2}$. Nt/No can be a scale of the proportion of double twinned crystal nuclei contained in Sample A. Therefore, Nt/No is plotted relative to the concentration of KI in the reactor with respect to various pBr, and then FIG. 6 is obtained. In either case, physical ripening with KSCN was conducted at pBr 1.85. As can be seen from FIG. 6, Nt/No generally has a maximum value.

That is, in a region of lower concentration than the KI concentration providing a maximum value at each pBr, residual grains are mainly tabular double twinned crystals, undissolved normal crystals, and single twinned crystals. As the KI concentration is increased, the probability of forming tabular double twinned crystals is increased. However, in a region of higher concentration than the KI concentration providing the maximum value, pyramid-like and unshaped grains having a very small aspect ratio, containing double or multi-twinned crystal nuclei in which the faces of the twinned crystals are not parallel, are increased in number, and the number of tabular grains is decreased.

Therefore, as is apparent from FIG. 6, the preferred KI concentration varies at each pBr. Based on FIG. 6, the preferred ranges of pI and pBr are shown in FIG. 7 by a region of slant lines.

Figure 3:
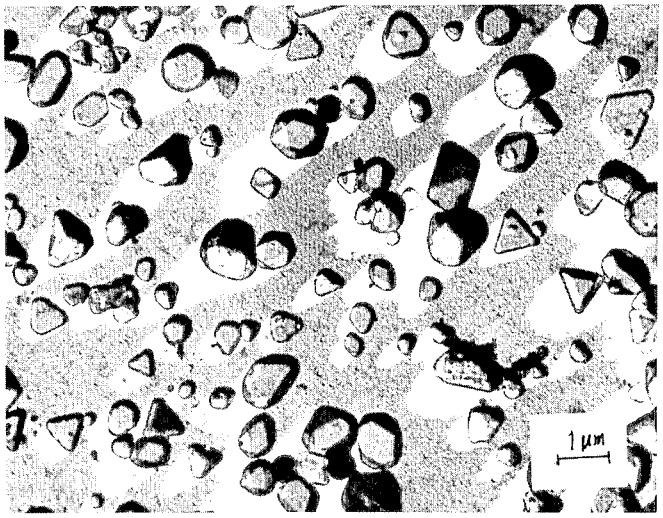
Figure 4:
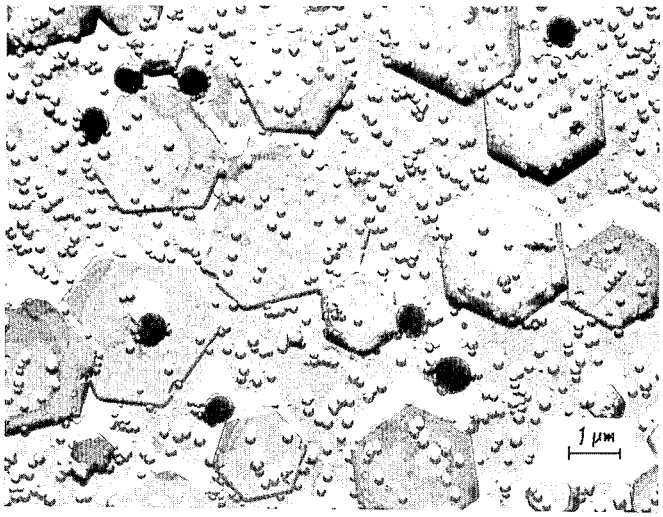

As comparative examples, electron microphotographs after physical ripening with KSCN at pBr of 1.70 and pI of 1.62 and 0 (KI is removed) (both do not satisfy the equation (I)) are shown in FIGS. 3 and 4, respectively.

As is apparent from FIG. 3, when KI is excessive, only unshaped grains having a low aspect ratio, containing non-parallel twinned crystals can be obtained. As is apparent from FIG. 4, when KI is not present at the initial stage, the proportion of regular crystals is high and the probability of forming tabular double twinned crystals is low and, therefore, tabular double twinned crystals are coarsened and a part of regular crystals grows and remains. When this is grown as a seed grain, the tabular grain size distribution is broadened and a number of regular crystals remain to the end.

REFERENCE EXAMPLE 2

According to the experimental method of Reference Example 1, at the optimum KI amount added at each pBr, the time of physical ripening by adding KSCN was changed to determine the time until regular crystals and single twinned crystals are not present after addition of KSCN (disappearing time). At this point, the average grain size of all grains, the standard deviation of the distribution and the variation coefficient (ratio of standard deviation to average grain size) were measured. The disappearing time was also determined for the comparative example, in which KI was not added. And the above measurements were made for this case. The results are shown in Table 1.

TABLE 1

| pBr | Amount of KI Added (mM) | Dis-appearing Time (min) | Average Grain Size (μm) | Standard Deviation (μm) | Variation Co-efficient |
|---|---|---|---|---|---|
| 1.25 | 0.6 | 25 | 0.42 | 0.13 | 0.31 |
| " | 0 | 35 | 0.59 | 0.24 | 0.41 |
| 1.70 | 3.0 | 50 | 0.60 | 0.20 | 0.33 |
| " | 0 | 75 | 2.02 | 0.79 | 0.39 |
| 1.85 | 6.0 | 50 | 0.65 | 0.20 | 0.31 |
| " | 0 | 85 | 3.14 | 1.44 | 0.45 |
| 3.00 | 12.0 | 60 | 0.75 | 0.42 | 0.56 |
| " | 0 | 100 | 3.56 | 2.70 | 0.76 |

In samples in which an optimum amount of KI is added at each pBr, the regular crystals and the single twinned crystals can be removed in shorter time, and, thus, production efficiency is markedly increased. At the same time, the average grain size of tabular grains formed and the standard deviation are markedly decreased, and the variation coefficiency becomes apparently a small value.

If these grains are further grown as seed grains, the size distribution at the desired average size and aspect ratio can be made sufficiently narrow. In accordance with the purpose, the distribution can be broadened. Thus, the degree of freedom is very high. Accordingly, they have ideal characteristics as seed grains.

EXAMPLE 1

50 ml of 4 N $AgNO_3$ was added with good stirring at a constant speed over 75 seconds to 1,000 ml of an aqueous solution containing 15 g of inactive gelatin, 2.4 g of potassium bromide and 0.50 g (3.0 mmol) of potassium iodide (pBr: 1.70, pI: 2.52) while maintaining it at 70° C. During this process, 4 N KBr was added at the same time while controlling pBr with a silver electrode so as to maintain pBr at 1.70. Then, 10 ml of a 2 N KSCN solution was added. Thereafter, a 2 N $AgNO_3$ solution and a mixed solution of the KBr and KI (2 N as KBr and 0.04 N as KI) were added at the same time over 10 minutes. The initial addition speed of the 2 N $AgNO_3$ was 6 ml/min, and the final addition speed was 74 ml/min. The amount of 2 N $AgNO_3$ added during this period was 400 ml and the pBr was maintained at 1.85. 2 Minutes after the completion of addition, the temperature was decreased, the mixture was washed with water and, thereafter, 120 g of inactive gelatin was added to make the volume of the emulsion 200 ml. After adjusting the pAg at 40° C. to 9.1 and the pH to 6.9, the temperature of the emulsion was adjusted to 60° C., and chemical sensitization was conducted over 60 minutes by adding 18 ml of 1 mM 5-benzyliden-3-ethyl rhodanine, 4.4 mg of chloroauric acid and 135 mg of potassium thiocyanate. This emulsion is referred to as Emulsion I-1.

Emulsion I-2 was prepared in the same manner as in the preparation of Emulsion I-1 except that as the $AgNO_3$ and KBr solutions to be added at the first step, 2 N solutions were used, the concentration of $AgNO_3$ to be added at the second stage was 2.25 N, the concentrations of the mixed solution of KBr and KI were 2.25 N as KBr and 0.04 N as KI, respectively, and 400 ml of 2.25 N $AgNO_3$ was added over 20 minutes. The initial rate of addition of 2.25 N AgNO was 3 ml/min, and the final rate of addition was 37 ml/min.

Emulsion I-3 was prepared in the same manner as in the preparation of Emulsion I-1, except that the 4 N KBr which was added simultaneously with 4 N $AgNO_3$ at the first step contained 0.08 M KI as a KI solution.

Emulsion I-4 was prepared in the same manner as in the preparation of Emulsion I-1, except that in the first step, 12.7 ml of 4 N $AgNO_3$ and 4 N KBr were added at a constant rate over 19 seconds while maintaining pBr at 1.25 to 1 liter of an aqueous solution (pBr: 1.25, pI: 2.99) containing 30 g of inactive gelatin, 6.7 g of potassium bromide and 0.17 g (1.0 mmol) of potassium iodide while maintaining the temperature of the solution at 70° C. and well stirring.

Figure 5:
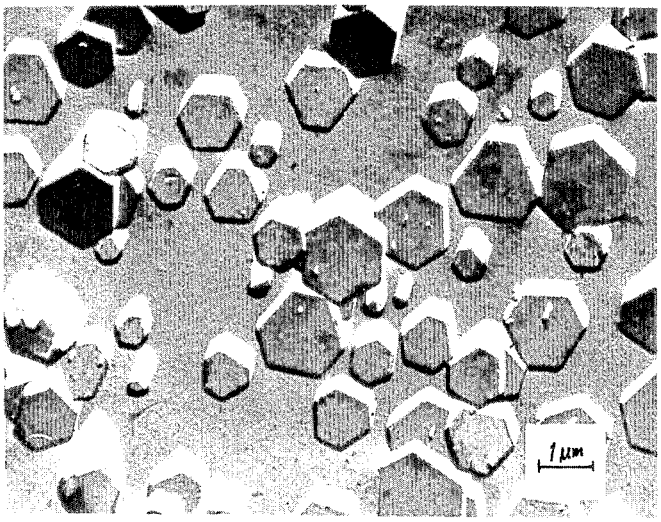

In connection with Emulsions I-1 to I-4, the average grain size, average thickness, average aspect ratio, and the ratio of the total project areas of grains having a grain size of not less than 0.5 μm and a thickness of not more than 0.3 μm to the total project areas of all grains are shown in Table 2. An electron microphotograph of Emulsion I-1 is shown in FIG. 5.

TABLE 2

| Emulsion | Average Grain Size (μm) | Average Thickness (μm) | Average Aspect Ratio | Ratio of Project Area (%) |
|---|---|---|---|---|
| I-1 | 1.43 | 0.16 | 8.9 | 94 |
| I-2 | 1.33 | 0.23 | 5.8 | 78 |
| I-3 | 1.30 | 0.16 | 8.1 | 90 |
| I-4 | 2.40 | 0.15 | 16.1 | 92 |

EXAMPLE 2

2 N $AgNO_3$ and 2.1 N KBr were added at the same time over 1 minute to 1 liter of an aqueous solution containing 15 g of inactive gelatin, 6.7 g of KBr and 83 mg (0.5 mmol) of KI (pBr: 1.25, pI: 3.30) while stirring well. During this period, the pBr was maintained at 1.25, and the 2 N $AgNO_3$ was added at a constant speed in a total amount of 20 ml. Thereafter, the addition speed was immediately changed, and 2 N $AgNO_3$ and 2.1 N KBr were added at the same time over 24 minutes while maintaining the pBr at 1.25. During this 24 minute period, the amount of 2 N $AgNO_3$ added was 480 ml, and the initial rate of addition was 10 ml/min and the final rate of addition was 30 ml/min. After 1 minute, the temperature was decreased until 40° C., the mixture was washed with water, and 120 g of inactive gelatin was added to make the total volume 2,000 ml and to adjust the pH to 6.5 and the pAg to 8.8 as determined at 40° C. This emulsion is referred to as Emulsion II-1.

Emulsion II-2 was prepared in the same manner as Emulsion II-1, except that after the first step (the 1 minute addition of 2 N $AgNO_3$ and 2.1 N KBr), the physical ripening was conducted for 20 minutes. Moreover, to prepare Emulsion II-2, conditions at the second step were changed; 2 N $AgNO_3$ and 2 N KBr were added at the same time over 60 minutes while maintaining pBr at 1.85. During this 60 minute period, the amount of 2 N $AgNO_3$ added was 480 ml, and the initial rate of addition was 2 ml/min and the final rate of addition was 14 ml/min. Thereafter, Emulsion II-2 was prepared in the same manner as in Emulsion II-1.

The same manner as in the preparation of Emulsion II-1 was repeated to prepare Emulsion II-3, except that 150 mg of 3,6-dithiooctane-1,8-diol was freshly added to 1 liter of an aqueous solution containing 20 g of inactive gelatin, 6.7 g of KBr, and 83 ml of potassium iodide, and further, after the completion of addition of $AgNO_3$ and KBr at the first step, the second step was carried out by adding 2 N $AgNO_3$ and 2.1 N KBr at a constant speed over 40 minutes while maintaining the pBr at 1.25. During this 40 minute period, the amount of 2 N AgNO added was 480 ml. Thereafter, Emulsion II-3 was prepared in the same manner as in Emulsion II-1.

Emulsion II-4 was prepared in the following manner. 50 ml of 4 N $AgNO_3$ was added at a constant speed over 75 seconds to 1 liter of an aqueous solution containing 15 g of inactive gelatin, 2.4 g of potassium bromide and 0.50 g of potassium iodide (pBr: 1.70, pI: 2.52) while maintaining the temperature at 70° C. and stirring well. During this period, 4 N KBr was added at the same time while controlling with a silver electrode so as to maintain the pBr at 1.70. Immediately after that, 2 N KSCN was added and physical ripening was conducted for 50 minutes, and immediately the temperature was decreased and the mixture was washed with water. Then, 30 g of inactive gelatin was added to make the total emulsion volume 500 ml and the mixture was adjusted to the pAg 9.1 and the pH 6.9 to prepare Emulsion II-4.

In connection with Emulsions II-1 to II-4, the average grain size, average thickness, average aspect ratio of grains having a grain size of not less than 0.5 μm and a thickness of not more than 0.3 μm, and the ratio of the total project area of the above grains to the total project area of all grains were measured, and the results are shown in Table 3.

TABLE 3

| Emulsion | Average Grain Size (μm) | Average Thickness (μm) | Average Aspect Ratio | Ratio of Project Area (%) |
|---|---|---|---|---|
| II-1 | 1.47 | 0.09 | 16.3 | 97 |
| II-2 | 1.20 | 0.11 | 10.9 | 95 |
| II-3 | 1.15 | 0.15 | 7.7 | 96 |
| II-4 | 0.82 | 0.10 | 8.2 | 87 |

EXAMPLE 3

This example illustrates the preparation of a comparative emulsion. 4N $AgNO_3$ and 4 N KBr were added at the same time while maintaining pBr at 1.25, to 1 liter of a solution containing 15 g of inactive gelatin and 6.7 g of potassium bromide (pBr: 1.25) so as to provide the probability of forming twinned crystals which is equal to Emulsion I-1 without $I^{\ominus}$ ions while maintaining the temperature at 70° C. and stirring well. During this period, the amount of 4 N $AgNO_3$ added was 50 ml. Thereafter, the preparation of the comparative emulsion was continued in the same manner as in Emulsion I-1.

The average grain size, standard deviation of grain size distribution and its variation coefficient of grains having a grain size of not less than 0.5 μm and a thickness of not more than 0.3 μm of each of Emulsion I-1 and the comparative emulsion of the example are shown in Table 4. Their average thicknesses were in agreement with each other within the range of 0.16±0.02 μm.

TABLE 4

| Emulsion | Average Particle Size (μm) | Standard Deviation (μm) | Variation Coefficient |
|---|---|---|---|
| Emulsion II-1 | 1.43 | 0.43 | 0.30 |
| Comparative | 1.41 | 0.58 | 0.41 |

TABLE 4-continued

| Emulsion | Average Particle Size (μm) | Standard Deviation (μm) | Variation Coefficient |
|---|---|---|---|
| Emulsion | | | |

It can be seen that Emulsion I-1 is equal to the comparative emulsion in respect of average grain size, but the size distribution obtained is more narrow than that of the comparative emulsion.

EXAMPLE 4

The Nt/No relation relative to pBr in the case where no KI was present and the relation between the Nt/No and pBr at various KI concentrations were again plotted from FIG. 6. This is shown in FIG. 8. That is, it can be seen that if formation of nucleus is performed at a pBr in the neighborhood of the maximum value of each curve at each KI concentration, the change of Nt/No relative to a change of pBr is markedly small as compared with that in the case where there is no KI. Thus, the reproducibility in preparing tabular grains can be greatly increased.

Emulsion I-1 and the comparative emulsion of Example 3 were each prepared 9 times, and the variation coefficient of average grain size in repeated preparation was measured and is shown in Table 5. There was no significant difference of average thickness in repeated preparations, and both variation coefficients were in the range of ±5%.

TABLE 5

| Emulsion | Number of Repeated Operations | Variation Coefficient of Average Grain Size |
|---|---|---|
| Emulsion I-1 | 9 | 0.063 |
| Comparative Emulsion | 9 | 0.11 |

As shown in Table 5, Emulsion I-1 produced by the method of the present invention is greatly improved in repeated reproducibility than the comparative emulsion.

As disclosed in Japanese Patent Application (OPI) No. 113928/83, there has been the need for the reaction solution not to substantially contain iodide ions because if in the reaction solution, iodide ion was contained at the time of introducing silver nitrate and potassium bromide, grains having a high thickness and a low aspect ratio are obtained. In other words, it has been taught that as the amount of iodide ions is increased, the thickness of the grown grain is increased, which is undesirable for the production of tabular grains having a high aspect ratio. Astonishingly, however, the present inventors have discovered that if a suitable amount of iodide ions is added, the probability of forming twinned crystals is remarkably increased without increasing the thickness in the neighborhood of the optimum addition amount at each pBr and finely divided seed grains of tabular twinned crystal grains can be obtained. Of course, if it is in excess of the optimum addition amount, the thickness of the grown tabular grains is increased and large amounts of non-parallel multi-twinned crystals and so forth are formed and, therefore, tabular grains having a high aspect ratio cannot be obtained. This is in agreement with the conventional concept. Furthermore, tabular seed grains prepared by introducing a preferred range of iodide ion at each pBr are more fine than those prepared under the same conditions, but without the presence of iodide ions, and furthermore they are grains having a small variation coefficient in size distribution. Moreover, the size distribution of tabular grains having a high aspect ratio formed by growing the above obtained seed grain is more narrow than that of the grains prepared by the conventional methods.

In addition, the change of the probability of forming twinned crystals relative to a variation of pBr is made small by introducing iodides in the reactor, and the reproducibility in repeated operations is markedly increased. This is a great advantage in commercial production.

Furthermore, there can be obtained advantages that in the preparation of finely divided tabular seed grains, in the case where normal crystals and single twinned crystals are removed, a physical ripening is greatly shortened and the production efficiency is increased, and, since, in growing grains using a part as the seed emulsion, a large amount of emulsion can be prepared using a very small amount of the seed emulsion, thereby leading to a marked increase in the production efficiency.

While the invention has been described in detail and with reference to specific embodiments thereof, it will be apparent to one skilled in the art that various changes and modifications can be made therein without departing from the spirit and scope thereof.

What is claimed is:

1. A method for preparing a light-sensitive silver iodobromide emulsion having a high aspect ratio, the emulsion containing a dispersion medium and silver iodobromide grains, with grains having a grain size of not less than 0.5 μm, a thickness of not more than 0.3 μm, and an average aspect ratio of not less than 5 constituting at least 50% of the total project area of the emulsion grains, comprising:

(a) introducing a silver salt, and a bromide salt or a bromide salt and iodide salt into a reactor in which at least part of the dispersion medium has been introduced;

(b) controlling the iodide ion concentration indicated by pI in the reactor prior to the introduction of at least the silver salt, and the bromide salt or the bromide salt and iodide salt within the range represented by the equation (I) as shown below:

$$\frac{1.50}{pBr} + 1.20 \leqq pI \leqq \frac{2.60}{pBr} + 1.33 \quad \text{(I)}$$

wherein pI and pBr indicate the logarithmic values of reciprocals of concentrations of dissolved iodide ions and bromide ion, respectively, and (c) maintaining the pBr at not less than 0.8 after the introduction of the silver salt, and bromide salt or the bromide salt and iodide salt.

2. A method for preparing a light-sensitive silver iodobromide emulsion having a high aspect ratio as in claim 1, wherein the iodide ion concentration indicated by pI is represented by the equation (II):

$$\frac{1.50}{pBr} + 1.30 \leqq pI \leqq \frac{2.60}{pBr} + 1.23 \quad \text{(II)}$$

3. A method for preparing a light-sensitive silver iodobromide emulsion having a high aspect ratio as in claim 1, wherein the pBr is 0.8 to 3.5.

4. A method for preparing a light-sensitive silver iodobromide emulsion having a high aspect ratio as in claim 2, wherein the pBr is 0.8 to 3.5.

5. A method for preparing a light-sensitive silver iodobromide emulsion having a high aspect ratio as in claim 1, wherein an average silver iodide content of the silver iodobromide grains is not less than 40 mol %.

6. A method for preparing a light-sensitive silver iodobromide emulsion having a high aspect ratio as in claim 1, wherein the grains have the grain size of 0.5 to 10 μm, the thickness of 0.005 to 0.3 μm, and the average aspect ratio of 5 to 25.

7. A method for preparing a light-sensitive silver iodobromide emulsion having a high aspect ratio as in claim 1, wherein the silver iodobromide grains are present in a proportion of at least 70%.

* * * * *